US010265963B2

(12) United States Patent
Tori et al.

(10) Patent No.: US 10,265,963 B2
(45) Date of Patent: Apr. 23, 2019

(54) CONTINUOUSLY REFILLABLE INK-JET CARTRIDGE

(71) Applicant: SICPA HOLDING SA, Prilly (CH)

(72) Inventors: Silvano Tori, Chiaverano (IT); Giovanni Morello, Baldissero Canavese (IT); Tazio Sandri, Verona (IT); Alessandro Scardovi, Ivrea (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 15/741,215

(22) PCT Filed: Sep. 12, 2016

(86) PCT No.: PCT/EP2016/071419
§ 371 (c)(1),
(2) Date: Dec. 29, 2017

(87) PCT Pub. No.: WO2017/055058
PCT Pub. Date: Apr. 6, 2017

(65) Prior Publication Data

US 2018/0186153 A1 Jul. 5, 2018

(30) Foreign Application Priority Data

Sep. 28, 2015 (EP) ..... 15187089

(51) Int. Cl.
*B41J 2/175* (2006.01)

(52) U.S. Cl.
CPC ..... *B41J 2/17509* (2013.01); *B41J 2/175* (2013.01); *B41J 2/17513* (2013.01);
(Continued)

(58) Field of Classification Search
CPC ..... B41J 2/17509
See application file for complete search history.

(56) References Cited

U.S. PATENT DOCUMENTS 4,959,667 A 9/1990 Kaplinsky
4,967,207 A * 10/1990 Ruder ..... B41J 2/17509 347/7

(Continued)

FOREIGN PATENT DOCUMENTS

EP 0639501 2/1995
EP 0908317 4/1999

(Continued)

OTHER PUBLICATIONS

Machine generated English translation of JP 2008-183836A to Ishibashi, "Ink Refilling Kit, and Method of Refilling Ink"; translation retrieved via https://worldwide.espacenet.com Jan. 14, 2019; 26pp.*

(Continued)

*Primary Examiner* — Shelby L Fidler
(74) *Attorney, Agent, or Firm* — Muncy, Geissler, Olds & Lowe, P.C.

(57) ABSTRACT

The present application relates to a continuously refillable ink-jet cartridge comprising a housing (2) having a bottom, a circumferential wall and a top, a backpressure element (3) contained in the housing (2), and a pipe (27) configured to inject ink through a mouth (28) into the housing (2). According to the present invention, the mouth (28) of the pipe (27) is located and configured such that it is at least partially surrounded by the backpressure element (3).

17 Claims, 11 Drawing Sheets

Composite backpressure generating element with drilled hole

Bottom feed printing module with extended pipe

(52) U.S. Cl.
CPC ..... *B41J 2/17553* (2013.01); *B41J 2/17556* (2013.01); *B41J 2/17566* (2013.01)

(56) References Cited

U.S. PATENT DOCUMENTS

| | | | | | |
|---|---|---|---|---|---|
| 4,968,998 | A | | 11/1990 | Allen | |
| 4,999,652 | A | * | 3/1991 | Chan | B41J 2/17513 347/86 |
| 6,007,190 | A | * | 12/1999 | Murray | B41J 2/175 347/85 |
| 6,238,042 | B1 | * | 5/2001 | Kobayashi | B41J 2/17506 347/86 |
| 6,505,923 | B1 | * | 1/2003 | Yamamoto | B41J 2/17503 347/85 |
| 6,536,871 | B1 | * | 3/2003 | Haddick | B41J 2/1408 347/50 |
| 2004/0150698 | A1 | * | 8/2004 | Caro | B41J 2/17553 347/86 |
| 2005/0174397 | A1 | * | 8/2005 | Scardovi | B41J 2/1652 347/85 |
| 2007/0046742 | A1 | * | 3/2007 | Inoue | B41J 2/17506 347/85 |
| 2009/0218270 | A1 | | 9/2009 | Harada | |
| 2010/0132830 | A1 | * | 6/2010 | Rittgers | B41J 2/17506 141/2 |
| 2012/0169813 | A1 | | 7/2012 | Gray et al. | |

FOREIGN PATENT DOCUMENTS

| | | | | | |
|---|---|---|---|---|---|
| EP | 1775131 | | 4/2007 | | |
| JP | 2008183836 | A | * | 8/2008 | B41J 2/17506 |
| WO | 2009073033 | | | 6/2009 | |
| WO | 2012168913 | | | 12/2012 | |

OTHER PUBLICATIONS

International Search Report and Written Opinion issued with respect to application No. PCT/EP2016/071419.

* cited by examiner

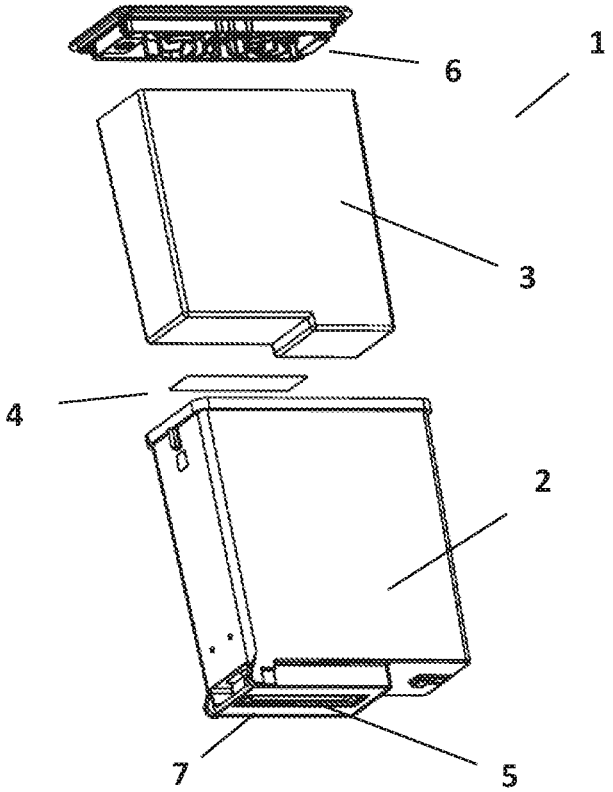
Figure 1 - Printhead cartridge: exploded view drawing

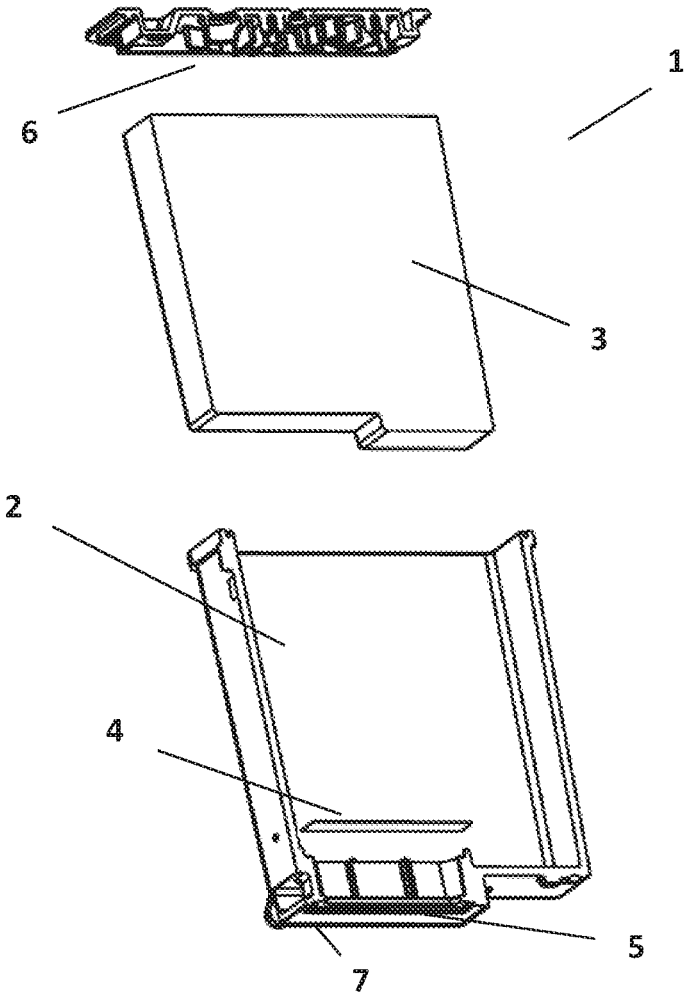
Figure 2 - Printhead cartridge cross section: exploded view drawing

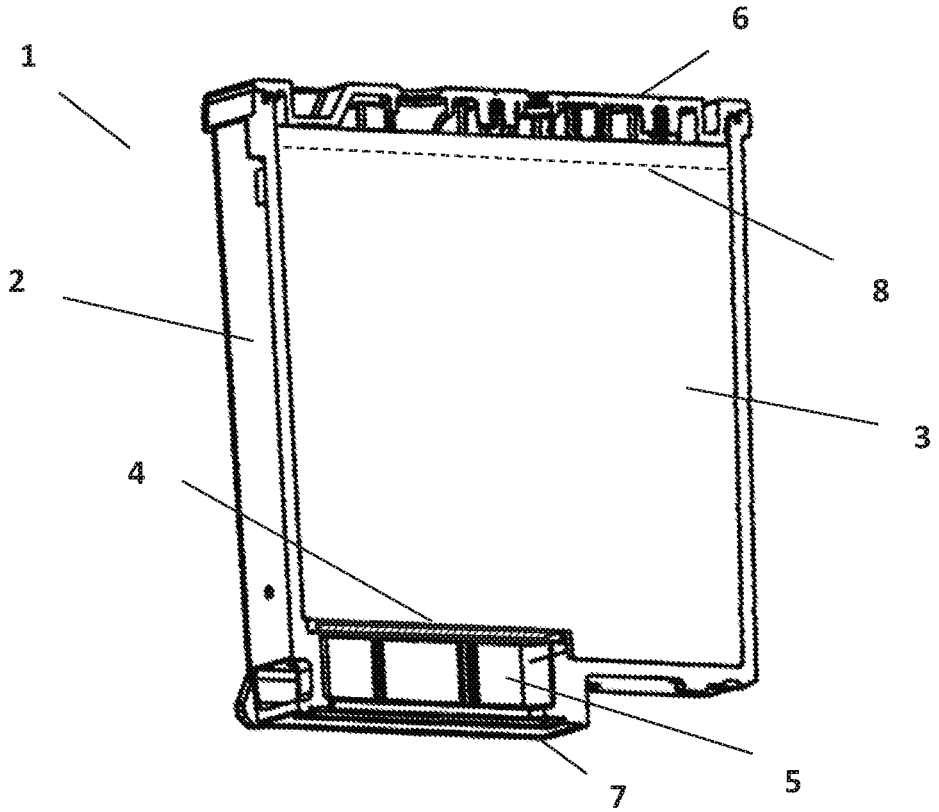
Figure 3 - Printhead assembled cartridge cross section view drawing

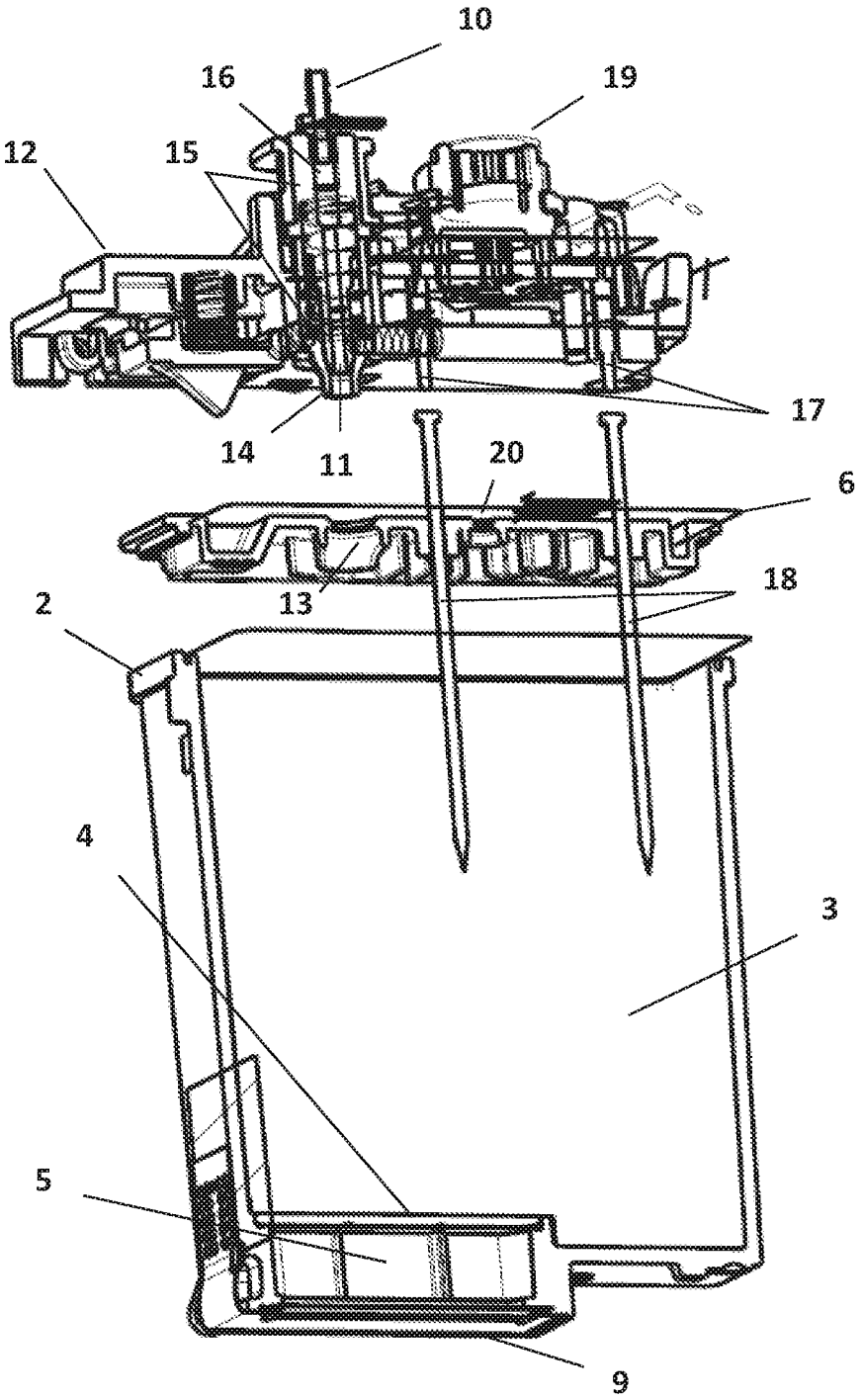
Figure 4 - Continuous refilling printhead cartridge cross section exploded view drawing

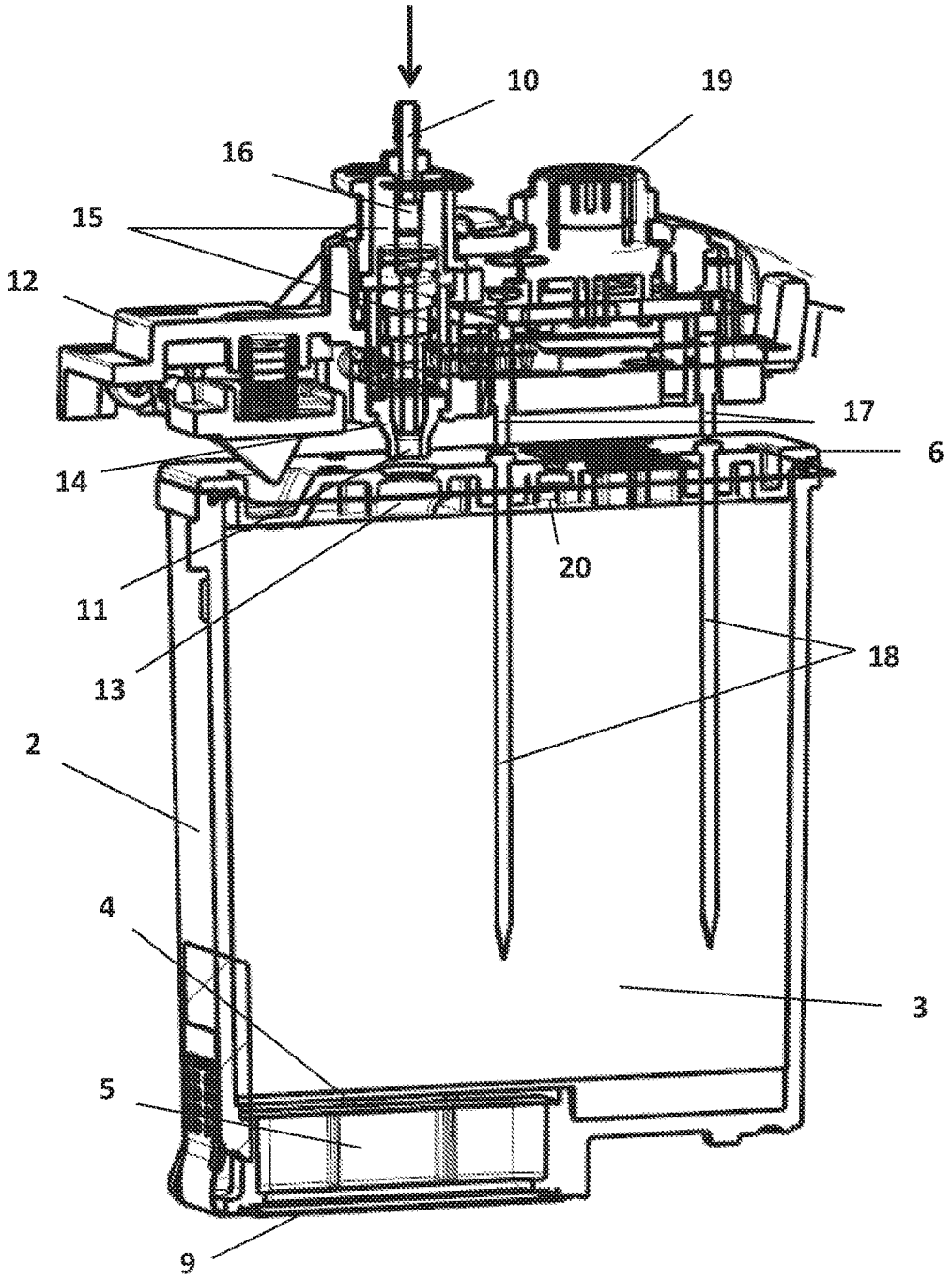
Figure 5 - Continuous refilling printhead cartridge cross section

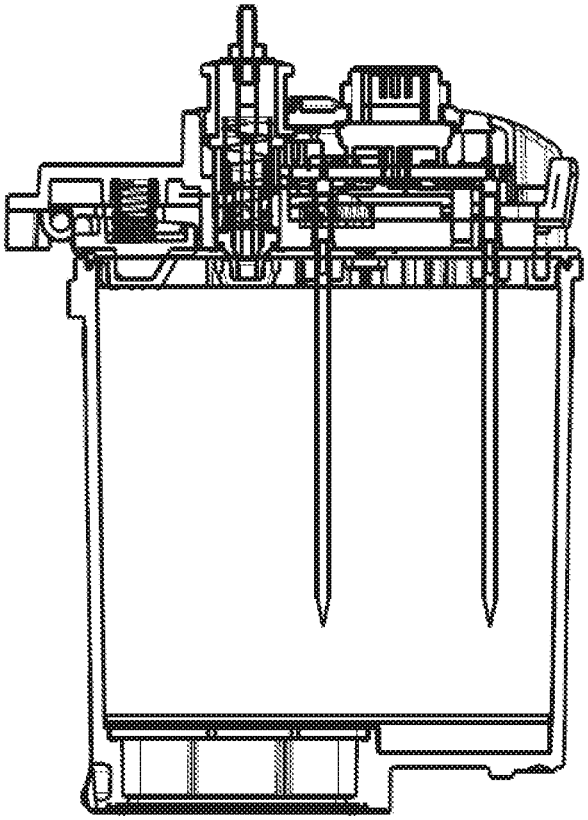
Figure 6 – printhead module

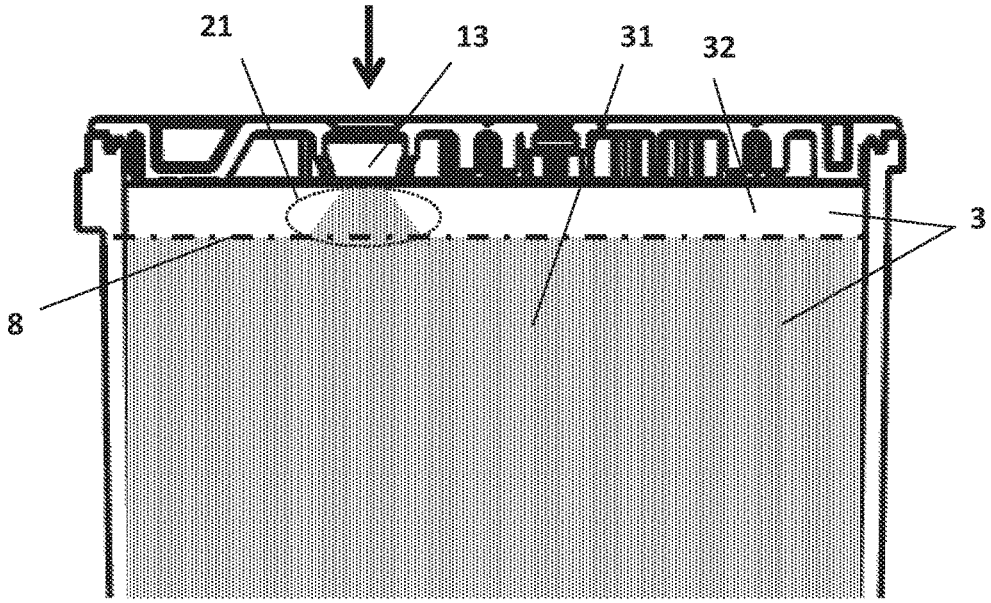
Figure 7 – Printhead module zoomed view: ink feeding region
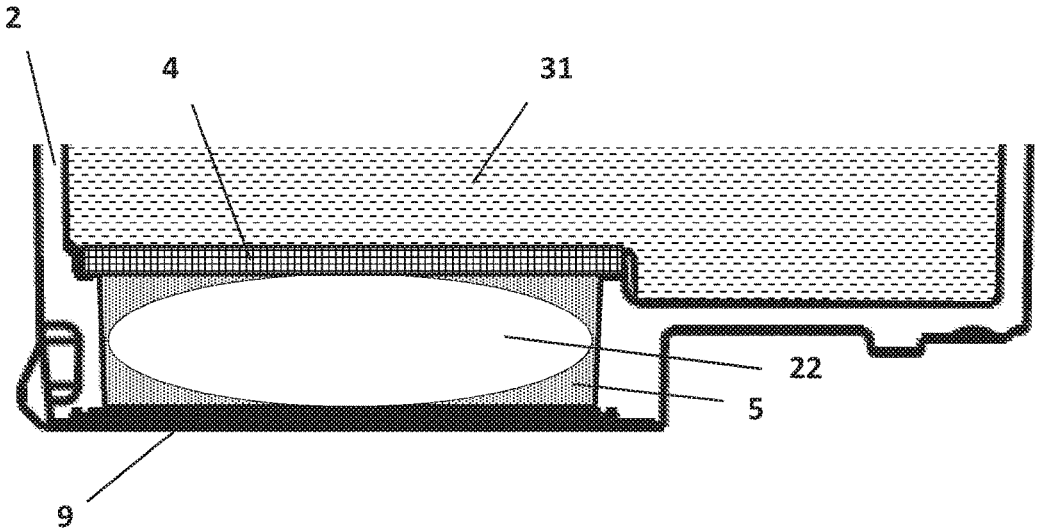
Figure 8 – Printhead module zoomed view: ink ejection region

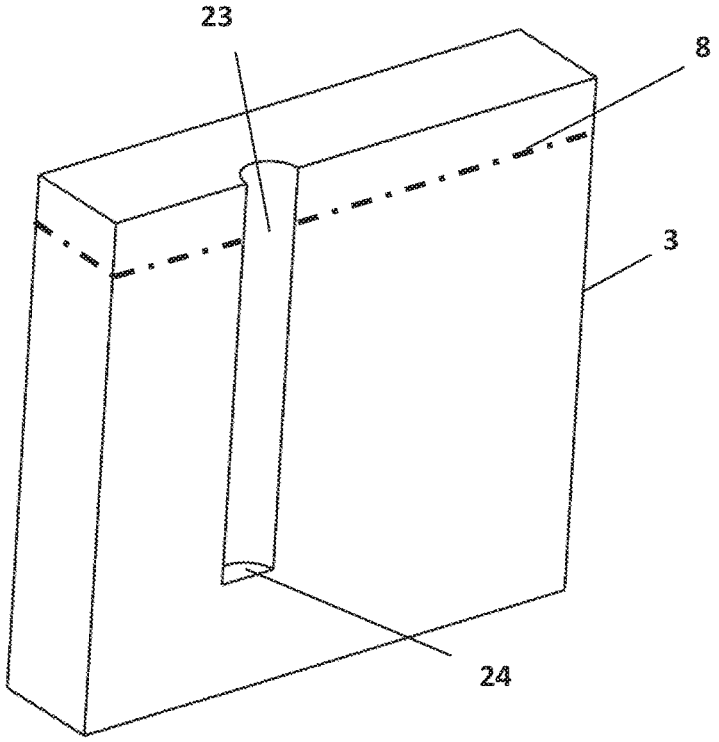
Figure 9 – Drilled hole in backpressure generating material
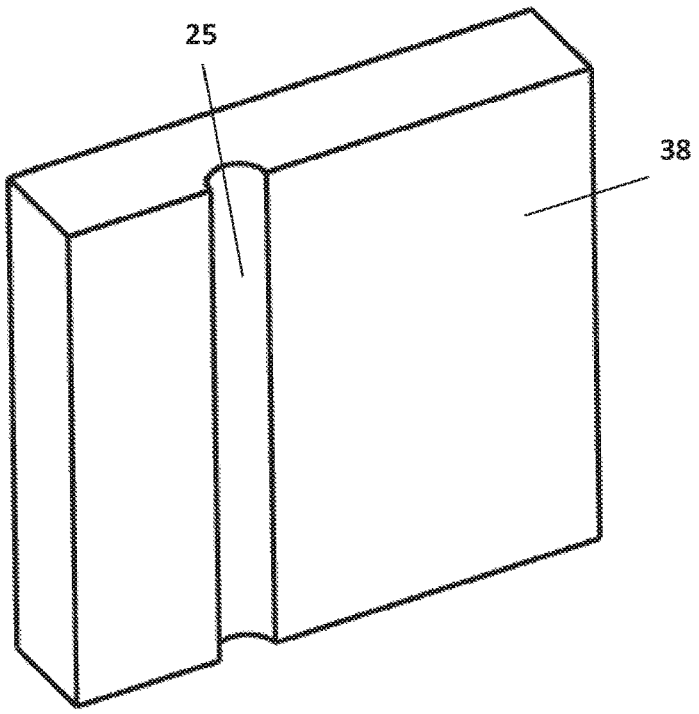
Figure 10 – Drilled hole in the upper rigid material

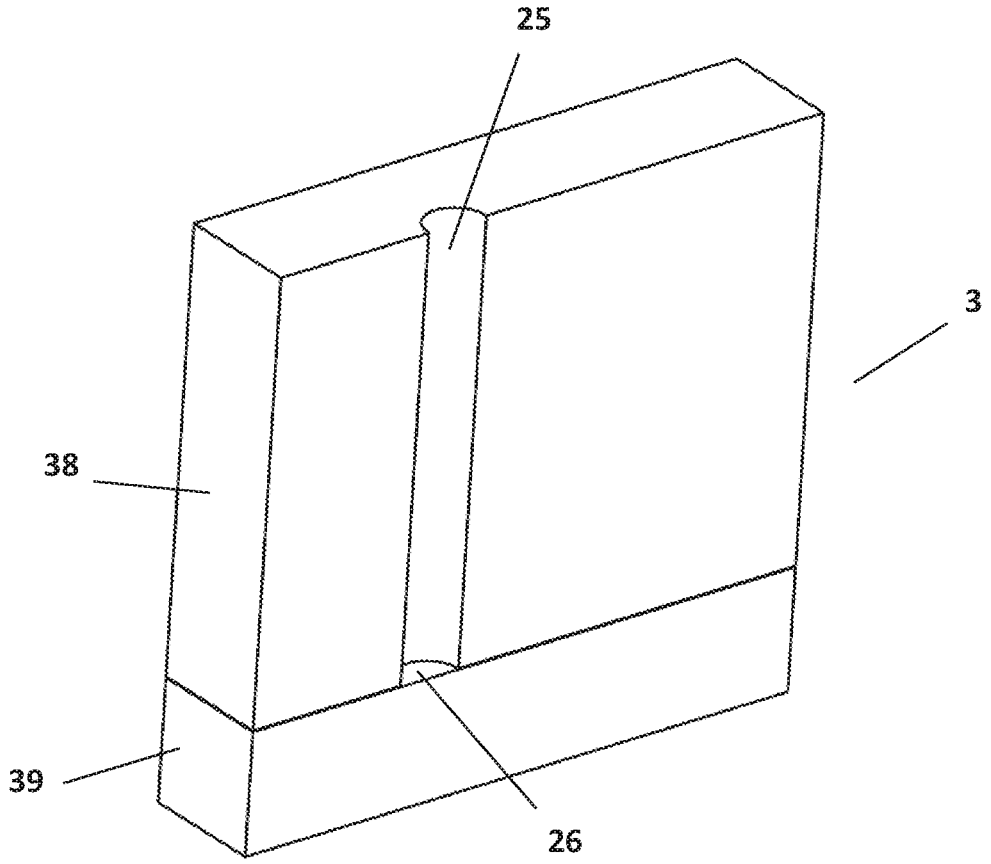
Figure 11 – Composite backpressure generating element with drilled hole

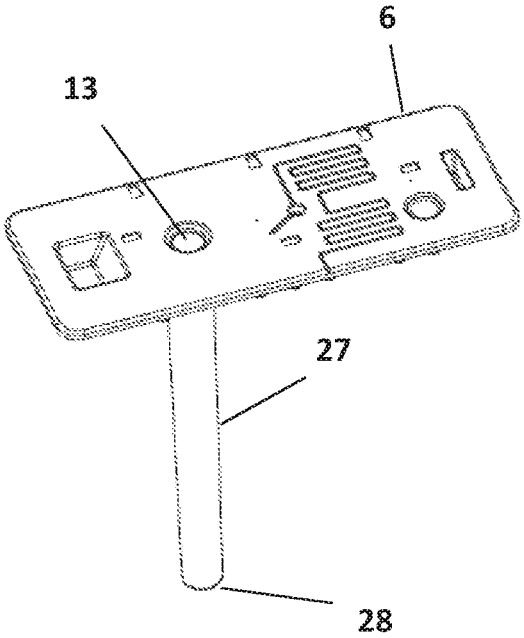
Figure 12 – Cartridge lid with extended pipe
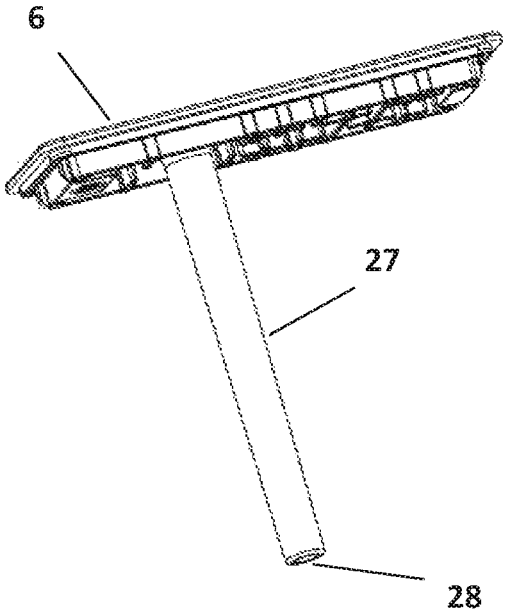
Figure 13 – Cartridge lid with extended pipe

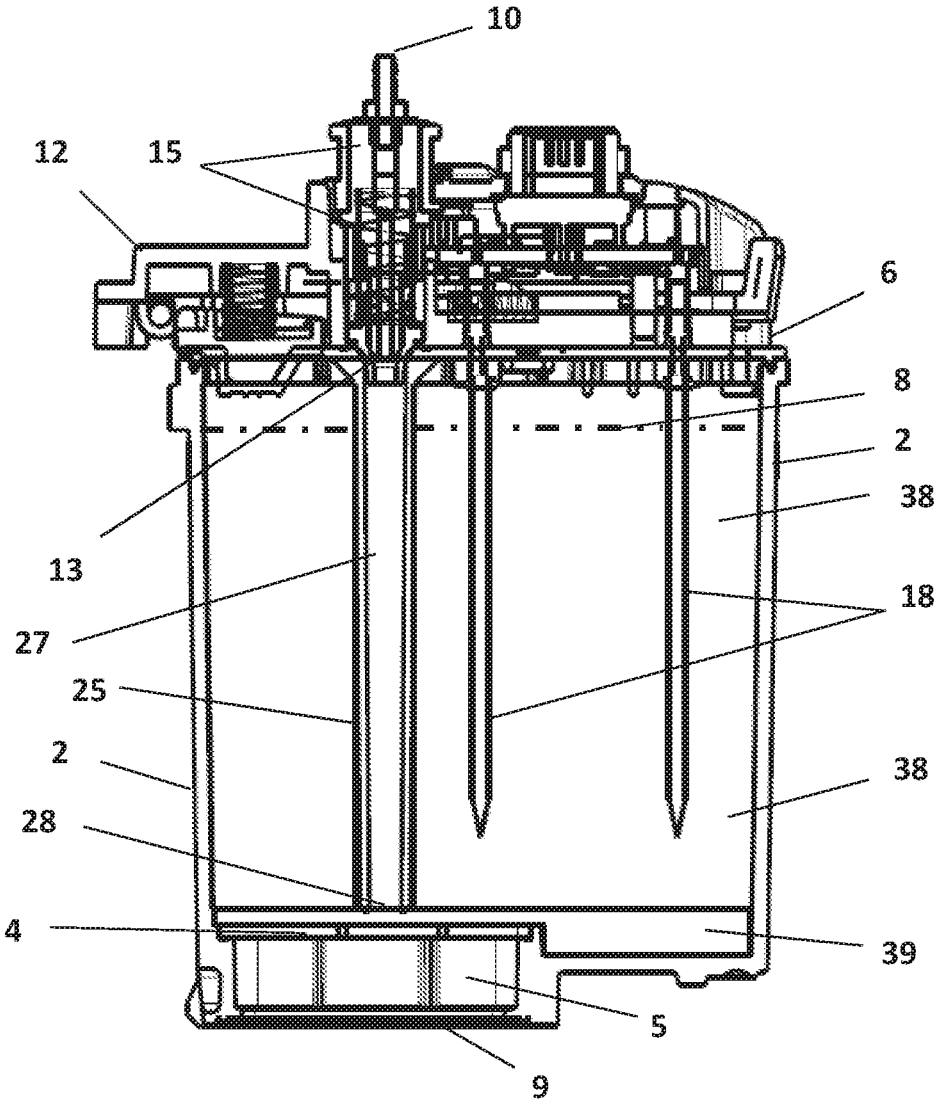
Figure 14 – Bottom feed printing module with extended pipe

CONTINUOUSLY REFILLABLE INK-JET CARTRIDGE

TECHNICAL FIELD

The present invention relates to a continuously refillable ink-jet cartridge comprising a housing having a bottom, a circumferential wall and a top, a backpressure element contained in the housing, and a pipe configured to inject ink through a mouth into the housing. The continuously refillable ink-jet cartridge belongs to the thermal ink-jet print head technology.

BACKGROUND

To refill an ink-jet cartridge from an external tank, a connection pipe is conventionally used which conveys the refilling liquid to an inlet port on a top of the cartridge or cartridge cover. If a porous material is used as a backpressure element to generate backpressure, the cartridge and the porous material are not completely filled up with ink, but an upper internal volume of the cartridge and backpressure element is in contact with a gas, usually air, and/or the outside.

The ink injected by the connection pipe drops down onto the porous material of the backpressure element and flows through the backpressure element finally arriving at a print head chip, where the droplet ejection of the print head takes place.

Even if the ink injected through the connection pipe has been outgassed, the upper internal volume of the cartridge and an upper portion of the backpressure element are filled with air at atmospheric pressure and, hence, the ink passing through the upper volume and upper portion re-captures gas present in these internal parts of the cartridge.

Among the issues that can compromise the correct working of an ink-jet print head, the growing of gas bubbles in the cartridge is a very harmful and shifty one: large size bubbles can heavily hamper the ink flow toward the ejection sites of the print head and even break it off completely.

In each ejection site of a thermal print head, where droplets are formed at the ejection rate, a current pulse through a heating resistor generates a thin vapor layer with an internal pressure of about 9 MPa. This high pressure, imparted to the neighboring liquid, is maintained for a very short time of usually less than 1 μs. Subsequently, the thermal bubble expansion causes the pressure to drop down rapidly and well below the atmospheric level. Such a strong depression (about −80 kPa) holds out for nearly the entire bubble evolution. In other words, the bubble is "seen" by the neighboring ink as a volume being in strong depression most of the time.

In static conditions, the ink is in equilibrium with its environment and it is nearly saturated with the dissolved gas. When the sudden depression occurs, this equilibrium is broken and part of the dissolved gas is extracted from the neighboring ink. After the collapse of the thermal bubble, such extracted gas remains inside the liquid in form of micro-bubbles of air. Due to continuous boiling action, these bubbles are pushed away from the chamber and some of them flow upstream in the standpipe, conveying the ink from the housing of the cartridge to the print head, where the ink is hardly affected by the pressure variations and, thus, remains substantially in equilibrium with the dissolved gas. Therefore, the air bubbles pushed upstream in the standpipe cannot be re-absorbed by a nearly saturated liquid and dwell in the flow path, e.g. below a filter between the housing and the standpipe.

Progressive printing activity can extract more gas from the ink, increasing the size of the gas bubbles in the standpipe. As the gas bubbles cannot escape from the standpipe, and if they grow beyond a critical size, they can constrict and even block the ink flow thereby causing the printing quality to severely deteriorate.

Another undesired effect is the instability of the drop characteristic due to the gas present in the firing chamber. Some micro-bubbles formed in the previous boiling phases may remain in the chamber on the surface of the resistors. When the latter are fired, the micro-bubbles form nucleation points and, therefore, the next boiling phase starts at a lower and variable super-heating temperature due to the random distribution of the micro-bubbles. When the micro-bubbles are present, bubbles of vaporized ink having smaller and unsteady size are generated during printing. This effect causes an intermittent and random decrease of the drop mass and velocity of usually about 20 percent.

A standard print head for the consumer market, i.e. for home and office applications, is usually a disposable one. Basically, as illustrated in FIGS. 1 and 2, a print head cartridge 1 comprises a cartridge body or housing 2, usually made of plastics, that houses a suitable backpressure generating element 3, the latter being made of a porous material like foam or fiber, or a combination of them. The backpressure element 3 almost completely fills out the ink reservoir inside the housing 2 and the ink occupies the pores of the material, flowing through them towards a print head chip to reach the ejection sites.

A filter 4, usually made of metal, is fitted into the cartridge at the lower side of the backpressure element 3 and prevents possible debris or particles, produced during the manufacturing, from reaching the microfluidic circuit of the print head.

Beyond the filter 4, a standpipe 5 forms the flow path through which the ink travels, before reaching the feeding slots at the backside of the print head chip. A lid 6, which forms the top of the housing 2, acts as a cover for the cartridge 1.

The ink contained in the cartridge 1 is sufficient to allow regular printing over a limited, but for consumer market sufficiently long, period of time. The ink can be outgassed before being filled into the housing 2 of the cartridge 1. Frequently, the ink is not even outgassed. In any case, the total amount of dissolved gas in the ink, either already present in not-outgassed ink or captured from internal surfaces of the cartridge 1, e.g. the backpressure element 3, where gas can be adsorbed, normally does not have a significant effect on the printing performance. In fact, the volume of the accumulated gas that can be released from the liquid ink in form of bubbles is small with respect to the volume of the standpipe 5 through which the ink travels, moving towards the print head, which is attached at a lower surface 7 of the housing 2.

Therefore, the ink in the cartridge 1 can be completely consumed without the print head undergoing any serious criticality due to gas bubbles. Even in case of a refilled cartridge, the device lifetime typically allows just a few refills of the ink and the total volume of the gas bubbles remains relatively low. As a conclusion, the problem of the gas bubble formation in a print head device can be kept under control in a disposable cartridge or even a refill cartridge.

On the other hand, gas accumulation tends to cause severe issues when the same cartridge is refilled continuously from outside with an adducting pipe that sinks the ink from an external tank, such as a bottle, even if the ink has been previously outgassed.

The large volume of ink that flows through a continuously refillable cartridge during the long-time printing operations leads to a prolonged contact between the liquid and the internal environment of the cartridge, which results in a higher risk of increasing the amount of gas captured in the ink and subsequently dissolved. Therefore, the formation of air bubbles due to the periodic depressions during printing is augmented. Hence, the bubbles can increasingly grow until they reach a critical size that blocks or obstructs the ink flow through the stand pipe 5, causing a failure of the print head.

In addition, the gas bubble generation by extraction of dissolved gas in the ink takes place much easier and causes a much more severe criticality when solvent based ink is used instead of water based ink. In fact, solvents tend to capture and release a larger amount of gas and the drawbacks during the printing can arise in a short time.

A backpressure in the hydraulic circuit containing the liquid ink is necessary to prevent the ink from dropping out of the housing, which otherwise would be caused from the hydrostatic pressure exerted by the ink column in the housing 2. This backpressure can be provided by a backpressure element, for example a porous medium whose capillarity acts as a retaining force on the ink. The porous medium could be foam or another porous material such as a textile, or a combination of different materials, being able to adequately fill the internal space in the housing 2, while accurately matching the filter 4 on the bottom of the housing 2. The details of the backpressure element 3 depend very much on the ink composition, and very often such a constraint largely reduces the range of usable materials, if the ink is solvent based.

The capillary forces in the porous material of the backpressure element 3 are interface phenomena and they take place at the boundary surface between a liquid and a gas. Therefore, the backpressure element 3 would not exert any retaining force, or backpressure, if it was completely sunk in the liquid or, in other words, if the liquid covered it completely. It is necessary that at least a small upper portion of the porous backpressure element 3 is not covered by the liquid in order that the capillary forces are established and the necessary backpressure can be generated in the cartridge.

As is illustrated in FIG. 3, the housing is only filled up to a maximum level which is located below the lid 6, i.e. the top of the housing 2, and below the upper end of the backpressure element 3. An actual ink level 8 in FIG. 3 takes its maximum value, i.e. equals the maximum level. The volume inside the housing 2 below the lid 6 and above the actual ink level 8 contains only gas or vapor. In this way, at the transition surface between the liquid ink and the gas, a suitable boundary interface is formed in the porous material, generating the desired backpressure.

FIG. 4 depicts a conventional print head cartridge for a continuous printing system, i.e. a continuously refillable ink-jet cartridge. In a continuous printing system, a large amount of ink is ejected from the print head 9 disposed on the bottom of the housing 2 during a longtime operation. An external pipe 10 conveys the ink into the housing 2 from an external tank (not depicted). The external pipe 10 is normally connected to an inlet port 11 placed on top of an upper cover 12 which upper cover 12 is in turn attachable to the lid 6 of the cartridge by means of a latching system.

The cover 12 has engaging features and sealing gaskets so that it can easily be removed from the lid 6. The cover 12 engages with a suitable ink feeding inlet 13 of the lid 6, wherein a gasket 14 ensures tightness of the connection between the latched cover 12 and the lid 6. An adapter 15 can be fitted to both the inlet port 11 on the cover 12 and an end 16 of the external pipe 10 to allow an easy and leak-free connection between the external pipe 10 and the cover 12 which guides the ink via the feeding inlet 13 through the lid 6 into the housing 2.

In addition, the cover 12 can also provide electric contacts 17, which can be used to establish a connection with ink level sensing elements 18, so that feedback with respect to the ink level in the housing 2 can be provided through an electrical connector 19 of the refilling device, in order to control and ensure the ink flow.

A venting port can be provided in the lid 6 to keep the volume above the backpressure element 3 and more particular above the ink in the backpressure element 3 at atmospheric pressure thereby facilitating drawing any liquid from the housing 2.

When the continuously refilled cartridge 1 has reached the end of its lifetime, it can be replaced with a new one, and the cover 12 can be engaged with the lid 6 of the new cartridge 1.

FIG. 5 shows the assembled cartridge 1 for a continuous refilling system, and FIG. 6 depicts the full configuration of the cartridge 1 and the cover 12 as well as the external pipe 10 and the means to inject ink into the housing 2 in its operating configuration.

In the prior art, as is depicted in FIG. 7, the ink conveyed from the external pipe 10 into the housing 2 through the inlet 13 drops down from the bottom side of the lid 6, directly onto the top side of the backpressure element 3. The backpressure element 3 has a lower portion 31 soaked in ink and an upper portion 32 which, in turn, is located in a gas or vapor environment. The boundary between these portions 31, 32 represents the actual ink level 8, indicated with the dash-dotted line in FIG. 7. The ink flows through the gaseous environment just below the lid 6 in the upper part of the housing 2 and travels spreading through the upper portion 32 of the backpressure element 3 which contains the same gas. Therefore, in the first part of the travel path into the housing 2, the ink interacts with the gas, either in the space above the backpressure element, or through the pores and at the surface of the upper portion 32 of the backpressure element 3. An interaction region 21 is approximately indicated by the dotted oval in FIG. 7.

As mentioned above, the captured gas subsequently dissolved in the ink can finally be extracted and released in the standpipe 5 beneath the filter 4. FIG. 8 illustrates a part of the housing 2, the filter 4, the stand pipe 5 and the print head 9. The lower portion 31 of the backpressure element 3 is soaked with ink and contacts an upper side of the filter 4. Beneath the filter 4, there is the standpipe 5 which is in fluid communication with the underlying print head 9. When a portion of the dissolved gas is extracted by the depression caused by the print head, small gas bubbles can grow into the ink. These gas bubbles can hardly follow the regular ink flow towards the ejection sites of the print head 9 because their density is much lower than the density of the ink. Hydrostatic forces tend to push them upwards so that they remain trapped in the standpipe 5 below the filter 4.

During the longtime ink flow, a large amount of gas can accumulate and be captured and released subsequently in form of a big bubble 22 trapped by the filter 4. Small bubbles can merge or can increase their own size, causing the forming of the bigger gas bubble 22 that grows continuously until some printing failure occurs due to the bubble obstructing the ink flow path in the standpipe 5.

This problem is conventionally addressed by a special cartridge design providing a secondary channel where an extraction and elimination process is performed using additional valves and pumping devices. However, this solution significantly increases complexity and cost of the printing system. Further, semi-permeable filters must be used according to this solution to avoid the extraction of the ink with the gas bubbles and the pumping parameters must be accurately set within a suitable operating range to exploit effectively such a filtering action.

OBJECTS

It is an object to provide a cheap and effective solution to avoid gas accumulation inside a continuously refillable ink-jet cartridge according to the above technical field without compromising the functionality of the backpressure element.

SUMMARY

A solution to the above mentioned object is provided by claim 1. Advantageous features are subject to the dependent claims.

Part of the solution to the object is recognizing that the reabsorption of gas in an outgassed ink, when it flows through the cartridge, is, to a large extent, caused by a protracted contact between the ink and the upper internal environment of the cartridge/housing that is full of air. The present idea aims at avoiding this protracted contact between the ink and the air or other gas in the upper internal environment of the cartridge/housing.

According to the subject described herein, a possible gas transfer is avoided by extending the pipe into the backpressure element within the housing beyond the boundary surface of ink and gas. More particularly, the continuously refillable ink-jet cartridge of the above technical field is characterized in that the mouth of the pipe is located and configured such that it is at least partially surrounded by the backpressure element.

As a result, the lower pipe end may be brought as close as possible to the bottom of the housing, e.g. a filter, where the ink can be sucked through the filter mesh into the flowpath and subsequently into the channels that lead to the firing chambers of the print head.

Beyond the filter, there is no more free air that can migrate inside the degassed ink. The backpressure element continues to exert its function in the cartridge hydraulic circuit, though the gas exchange can be dramatically reduced because the main ink flow takes place through the extended pipe, whose end remains below the level of the liquid in the housing, and almost the entire height of the porous material can, under certain circumstances, act as a barrier for the diffusion of gas from the air or gas present in the upper part of the housing or backpressure element.

This solution allows a surprisingly reliable longtime working of the printing system with a simple and cheap modification of the cartridge components.

Preferably, the mouth of the pipe is located at a first distance from a bottom side end of the backpressure element, wherein the first distance is less than a half, preferably less than a third, further preferably less than a fourth, of a first height between a bottom side end of the backpressure element and a top side end of the backpressure element. Also preferably, the mouth of the pipe is located at a second distance from the bottom of the housing, wherein the second distance is less than a half, preferably less than a third, further preferably less than a fourth, of a second height between the bottom of the housing and the top of the housing.

Locating the mouth of the pipe at the first and/or second distance from the bottom side end of the backpressure element and/or the bottom of the housing, respectively, as specified above improves the effect of avoiding the absorption of gas. Firstly, the lower the mouth of the pipe is located in the backpressure element and/or housing, the more can the ink in the backpressure element and/or housing be used up before refilling is required in order not to let the refilled ink contact gas. Secondly, the greater the distance between the mouth, and hence the fed ink, and the surface of the ink, the more static are the uppermost layers of ink thereby further hindering the absorption of gas in the ink.

In a preferred cartridge, the backpressure element is made of porous material, in particular foam, fibers or a combination thereof. Such a backpressure element uses capillary forces in order to balance hydrostatic pressure of the column of the liquid. In order for it to function, the backpressure element must be kept in a state where at least a small portion at the top of it is in contact with a gas. In other words, the backpressure element must not be completely submerged in ink.

Advantageously, the cartridge further comprises a filter for preventing debris or particles from reaching a print head, wherein the filter preferably is made of metal. Such a filter allows the print head to more reliably work since it is reliably prevented that solid particles reach the print head which would result in failure of the print head. On the other hand, a filter usually bears the risk of gas bubbles growing, thereby obstructing the flow path of the ink, as it traps the gas beneath the filter, i.e. inside of the flow path.

Preferably, the top of the housing is realized by a removable lid. A removable lid facilitates opening the cartridge, e.g. for maintenance work or in order to adapt the lid to a feeding pipe or other terminal(s). However, it is also possible that the top of the housing cannot be opened but is permanently closed e.g. by means of soldering a lid onto the circumferential wall.

According to a preferred cartridge, a predetermined maximum ink level is defined for the housing up to which the housing is filled with ink, preferably wherein the mouth is located further towards the bottom of the housing than the predetermined maximum ink level. The predetermined maximum ink level can be indicated by a mark on the housing or in the backpressure element, or by a defined height of ink within the housing which can, for example, be measured by electronic means.

Preferably, the backpressure element comprises a hole, in particular a blind hole, for receiving the pipe. Such a hole allows the pipe to be inserted into the backpressure element without damaging the backpressure element and without influencing the structure of the backpressure element. The structure of the backpressure element is relevant for its function, particularly if it is based on capillary forces. However, as one of several possible alternatives, the pipe can be integrally formed with the circumferential wall of the housing so that it is not necessary to drill a hole into the backpressure element. Further alternatively, it is of course also possible that the pipe is simply inserted into the backpressure element which, depending on the material and structure used for the backpressure element as well as the shape of the pipe, can be sufficient to penetrate the backpressure element without damaging it.

In a preferred cartridge, the backpressure element comprises a first member and a second member, wherein the first member is less resilient than the second member, wherein the first member comprises a hole and wherein the second member is located adjacent to the bottom of the housing and the first member is located above, in particular on top of and contacting, the second member. A more resilient member facilitates an adaption of the backpressure element to the shape of the housing. This is particularly helpful in the lower part of the housing. On the other hand, a less resilient member provides for a more stable shape and facilitates e.g. providing the hole for the pipe or other modifications to the shape which are meant to be permanent.

In a preferred embodiment, the backpressure element generally comprises a first member and a second member, the second member being located beneath and in contact with the first member, and being located adjacent to the bottom of the housing, thus between the bottom of the housing and the first member. This configuration generally allows for choosing different materials for the first member and the second member. The first and second members may not only differ in resilience, but also in their reactions to the ink which contacts the first and second members as well as in different capabilities of adapting their shape and size to external shapes.

As a particularly preferred example, the first element may preferably be composed of a fiber structure which is advantageous in that it is robust also when being contacted by solvent containing ink, although it can hardly match an internal shape of the housing. The second element may preferably be formed of foam, wherein the foam is sufficiently thin to avoid swelling by more than 10% of its volume when being contacted by solvent containing ink. This foam has the advantage that it can be well adapted to the internal shape of the housing.

It is further generally preferred, but particularly preferred in context of the example described immediately above, to let the pipe, more specifically the mouth of the pipe, contact the second member. In an embodiment, the mouth of the pipe is at least partially surrounded by the second element which means that the pipe slightly interferes with the second element and slightly penetrates the second element.

In this configuration, the effect of preventing absorption of gas by the ink is particularly well achieved. If the mouth of the pipe remains in the first member, the effect of preventing absorption of gas by the ink is not as well accomplished so that it is preferred to have the mouth of the pipe contact and preferably be at least partially surrounded by the second element.

In a preferred embodiment a distance between the pipe mouth and the standpipe or a filter is smaller than 8 mm, preferably smaller than 3 mm, in particular between 1 mm and 8 mm or preferably between 1 mm and 3 mm.

In a further preferred embodiment, the backpressure element comprises a first member and a second member, the second member being located beneath and in contact with the first member, and being located adjacent to the bottom of the housing, thus between the bottom of the housing and the first member, in particular as described above. Here, it is preferred that a thickness of the second element is between 3 mm and 8 mm. It is generally preferred that a distance between the mouth of the pipe and a mouth of a standpipe, a filter or generally a place where the ink exits the second element, is smaller than the thickness of the second element, in particular 1 mm smaller than the thickness of the second element. In the above mentioned example, this distance is between 2 mm and 7 mm. This allows for a good contact between the mouth of the pipe and the second element without exerting too much compressive force to the second element.

In the present case, it is particularly preferred if the hole in the first member is a thru-hole which extends all the way through the first member so that the mouth of the pipe can be located in contact with the second member. Preferably, the first member has a much larger vertical height than the second member and ensures in this way that the mouth of the pipe can be located in the vicinity of the bottom of the housing so that the vertical distance between the mouth of the pipe and the ink level is high.

In one preferred embodiment, the pipe is configured as penetrating the top. In other words, the ink is fed through the top of the housing and guided through the pipe deeply into the housing and the backpressure element.

In another preferred embodiment, the pipe is configured to contact the circumferential wall of the housing. Preferably, the pipe is configured integrally with the circumferential wall. Accordingly, it does not penetrate the backpressure element but is guided next to it. The mouth is preferably located next to the backpressure element or can be configured to penetrate into the backpressure element in a horizontal direction.

It is also possible that the pipe penetrates the top and is, in other portions along its extension, integrally formed with or guided along and preferably in contact with the circumferential wall.

According to a further preferred embodiment, the pipe is configured to penetrate the circumferential wall. In this embodiment, the pipe can be configured such that it does not substantially extend in the vertical direction inside of the housing, but can be guided along a substantially horizontal direction. Preferably, the circumferential wall of the housing is penetrated at a height well below the usual, or determined, ink level.

Preferably, the housing comprises an ink level sensing element so that feedback can be provided in order to control an amount of ink to be injected at a determined point of time. The ink level sensing element can comprise a sensor located inside of the housing as well as electrical connection means and electronics. However, also only isolated elements or parts of these elements are considered to be an ink level sensing element in the above sense.

Further preferably, the cartridge comprises a print head which comprises a microcircuit, preferably wherein the print head comprises a heating resistor for generating a vapor layer for ejecting ink from the print head.

A preferred cartridge is free of a semi-permeable filter and is free of a secondary channel for an extraction process of gas contained in the ink. This allows for a simple and efficient design of the cartridge if compared to the prior art avoiding the generation of gas bubbles at the print head.

Further features and advantages become apparent from the below description of the drawings and the claims appended thereto.

BRIEF DESCRIPTION OF THE DRAWINGS

FIG. 1 illustrates an exploded perspective view of a conventional disposable ink-jet cartridge;

FIG. 2 illustrates an exploded cross sectional view of a conventional disposable ink-jet cartridge;

FIG. 3 illustrates a cross sectional view of an assembled conventional disposable ink-jet cartridge;

FIG. 4 illustrates an exploded cross sectional view of a conventional continuously refillable ink-jet cartridge;

FIG. 5 illustrates a cross sectional view of an almost assembled conventional continuously refillable ink-jet cartridge;

FIG. 6 illustrates a cross sectional view of a fully assembled conventional continuously refillable ink-jet cartridge;

FIG. 7 illustrates a detailed cross sectional view of a conventional continuously refillable ink-jet cartridge while ink is injected into the cartridge;

FIG. 8 illustrates a further detailed cross sectional view of a conventional continuously refillable ink-jet cartridge, showing a bottom portion in the vicinity of a print head;

FIG. 9 illustrates a perspective view of a part of an embodiment having a blind hole in the backpressure element;

FIG. 10 illustrates a perspective view of a part of an embodiment having a through hole in a first member of the backpressure element;

FIG. 11 illustrates a perspective view of the first member of the backpressure element according to FIG. 10 and a second member of the backpressure element;

FIG. 12 illustrates a perspective view of a part of an embodiment having an extended pipe on a lid of a housing;

FIG. 13 illustrates the embodiment of FIG. 12 from a different point of view; and FIG. 14 illustrates a cross sectional view of an embodiment of a cartridge with parts of a refilling device attached to the cartridge.

DETAILED DESCRIPTION

The proposed solution does not require any extra device and can be implemented with a minimal variation in the cartridge design. It is based on the consideration that, since the critical region of the ink travel is just below the lid 6 and in the upper part of the backpressure element 3 where the probability of gas capture and dissolving in ink is relatively high, the pipe is extended towards the bottom of the housing 2 through the backpressure element 3. In particular, the mouth of the pipe can be located much closer to the bottom of the housing 2 which usually comprises a filter 4 than to the top of the housing 2 so that the mouth of the pipe remains fully immersed in the liquid ink at all times, almost regardless of the actual ink level 8 within the housing 2. Since refilling usually is carried out frequently and, therefore, the difference between the minimum and the maximum of the actual ink level 8 is relatively low, upper layers of the ink in the housing 2 remain practically static so that any gas exchange rate between the air in the upper portion of the housing 2 and the backpressure element 3 with the underlying ink is very small which means that the risk of having a gas bubble growth is significantly reduced if compared to conventional cartridges. In fact, this solution allows several liters of ink to flow through the same cartridge, without any deterioration in printing due to gas bubble obstruction.

One simple way to accomplish this pipe elongation, as depicted in FIG. 9, is to drill a longitudinal blind hole 23 or hole into the backpressure material 3, in order that it can house the elongated pipe without being damaged. The drilling depth can be chosen such that the pipe terminates in the bottom 24 of the blind hole, well below any acceptable, or usually accepted, actual ink level 8 in the backpressure element 3.

In a further embodiment, as depicted in FIGS. 10 and 11, the backpressure element 3 comprises two members 38, 39 of different porous materials that constitute the whole composite backpressure element 3. A larger, rigid element may form the first member 38 which is configured to be placed on top of a smaller flexible element which may form the second member 39 and is configured to be placed on the bottom of the housing 2, in order to get a better matching with the rigid bottom of the housing 2, in particular the filter 4.

It is possible to drill or otherwise form a thru-hole 25 which passes through the complete first member 38 in order that the extended pipe can get in contact with a top part 26 of the second member 39.

In further embodiment, the extended pipe can be incorporated with the housing, e.g. in contact with or as part of the circumferential wall so that no drilling of the backpressure element 3 is necessary. In this embodiment, the housing can be formed such that a pipe is formed from a feed inlet of the housing to a location deep inside the housing 2 where the mouth of the pipe is at least partially surrounded by the material of the backpressure element. Hence, the ink fed into the housing 2 does not contact the air or other gas in the upper portion of the housing 2 or backpressure element 3.

According to a further embodiment, the pipe the mouth of which being at least partially surrounded by the backpressure element 3 can laterally pass through the circumferential wall of the housing 2 at a height above the filter level but beneath the actual ink level 8.

According to a preferred embodiment, as depicted in FIGS. 12 and 13, the extended pipe 27 is integrally formed with the lid 6 which forms the top of the housing 2. Preferably, it is produced by molding. The pipe 27 is connected to the inlet 13 on its upper side and terminates with the mouth 28 on its bottom side. According to another possible embodiment, the pipe 27 and the lid 6 can be produced as separate parts and be joined and sealed subsequently. In both cases, the final result preferably is a single piece that can be inserted into the drilled material and soldered, clipped or otherwise attached to the circumferential wall of the housing 2.

In a preferred embodiment, illustrated in FIG. 14, the backpressure element 3 consists of two adjacent members: the upper first member 38 is fully drilled to get the hole 25, so that the mouth 28 of the pipe 27 gets in touch with the lower, second member 39, placed just above the filter 4.

This configuration provides a particularly efficient coupling between the mouth 28 of the pipe 27 and the backpressure element 3. The bottom feed of the ink significantly reduces the gas capturing by the outgassed ink of conventional cartridges, resulting in an increased stability of the printing performance.

The solution described herein allows continuous printing operation of an externally refilled ink-jet cartridge without the drawbacks of the prior art due to gas bubbles grown in the ink's flow path. Many liters of ink can flow through the cartridge keeping a stable printing quality, even in the case of a solvent based ink which is much more critical, if compared to a water based ink.

Hence, the solution described herein can be adopted conveniently for industrial applications where large amounts of ink are used. A further advantage is that the pressure loss through the cartridge due to hydraulic impedance of the backpressure element through which the ink flows, can be significantly reduced with respect to the prior art, if the refilling ink is delivered in close proximity to the filter, skipping the impedance of the porous material. Further, the actual ink pressure at the ejection site in the print head can be made less prone to undergo fluctuations during refilling which results in an even better printing stability and printing quality.

The embodiments described herein are in no way limiting the invention to the particular configurations illustrated and described, but the invention is defined by the appended claims and equivalents thereto.

The invention claimed is:

1. A continuously refillable ink-jet cartridge comprising a housing having a bottom, a circumferential wall and a top, a backpressure element which is made of porous material and is contained in the housing, and a pipe configured to inject ink through a mouth into the housing to continuously refill the cartridge, wherein the mouth of the pipe is located and configured such that it is at least partially surrounded by the backpressure element, wherein the cartridge further comprises a standpipe configured to guide the ink towards a print head, wherein the mouth is located relative to an inlet of the standpipe at a first distance of less than a half of a first height between a bottom side end of the backpressure element and a top side end of the backpressure element or wherein the mouth is located relative to an inlet of the standpipe at a second distance of less than a half of a second height between the bottom of the housing and the top of the housing, wherein the cartridge is configured to start refilling the ink as soon as an actual ink level reaches a minimum height above the mouth.

2. The cartridge of claim 1, wherein the mouth is located relative to the inlet of the standpipe at the first distance of less than a third of the first height between the bottom side end of the backpressure element and the top side end of the backpressure element and/or wherein the mouth is located relative to the inlet of the standpipe at the second distance of less than a third of the second height between the bottom of the housing and the top of the housing.

3. The cartridge of claim 1, wherein the mouth of the pipe is located at a first distance from a bottom side end of the backpressure element, wherein the first distance is less than a half of a first height between a bottom side end of the backpressure element and a top side end of the backpressure element.

4. The cartridge of claim 1, wherein the mouth of the pipe is located at a second distance from the bottom of the housing, wherein the second distance is less than a half of a second height between the bottom of the housing and the top of the housing.

5. The cartridge of claim 1, wherein the porous material comprises foam, fibers or a combination thereof.

6. The cartridge of claim 1, wherein the top of the housing is realized by a lid, in particular a removable lid.

7. The cartridge of claim 1, wherein a predetermined maximum ink level is defined for the housing up to which the housing is filled with ink, wherein the mouth is located further towards the bottom of the housing than the predetermined maximum ink level.

8. The cartridge of claim 1, wherein a minimum ink level is defined for the housing so that the mouth remains fully immersed in the ink at all times.

9. The cartridge of claim 1, wherein the backpressure element comprises a first member and a second member, wherein the first member is less resilient than the second member, wherein the first member comprises a hole and wherein the second member is located adjacent to the bottom of the housing and the first member is located above, in particular on top of and contacting, the second member.

10. The cartridge of claim 1, wherein the backpressure element comprises a first member and a second member, the second member being located beneath and in contact with the first member, wherein the first member and the second member are made of different materials, wherein the mouth of the pipe contacts the second element, wherein the mouth is at least partially surrounded by the second element.

11. The cartridge of claim 1, wherein the pipe is configured as penetrating the top.

12. The cartridge of claim 1, wherein the pipe is configured to contact the circumferential wall of the housing.

13. The cartridge of claim 1, wherein the pipe is configured to penetrate the circumferential wall.

14. The cartridge of claim 1, wherein the housing comprises ink level sensing elements so that feedback can be provided in order to control an amount of ink to be injected at a determined point of time.

15. The cartridge of claim 1, comprising a print head which comprises a microcircuit, wherein the print head comprises a heating resistor for generating a vapor layer for ejecting ink from the print head.

16. The cartridge of claim 1, wherein the cartridge is free of a semi-permeable filter and wherein the cartridge is free of a secondary channel for an extraction process of gas contained in the ink.

17. A method of refilling a continuously refillable ink-jet cartridge, the cartridge comprising a housing having a bottom, a circumferential wall and a top, a backpressure element contained in the housing, and a pipe configured to inject ink through a mouth into the housing, wherein the mouth is located and configured such that it is at least partially surrounded by the backpressure element, the cartridge further comprising a standpipe configured to guide the ink towards a print head, wherein the mouth is located relative to an inlet of the standpipe at a first distance of less than a half of a first height between a bottom side end of the backpressure element and a top side end of the backpressure element or wherein the mouth is located relative to an inlet of the standpipe at a second distance of less than a half of a second height between the bottom of the housing and the top of the housing, the method comprising fully immersing the mouth in the ink during refilling of the ink into the housing, wherein refilling of the ink is started as soon as an actual ink level reaches a minimum height above the mouth.

* * * * *